United States Patent [19]

Gardell et al.

[11] Patent Number: 4,765,697

[45] Date of Patent: Aug. 23, 1988

[54] DISHWASHER DOOR WITH INTERLOCKING MOLDED CONSOLE AND MOLDED INNER DOOR

[75] Inventors: Dale W. Gardell, Hagar Township; Larry D. Marks, St. Joseph Township, both of Mich.

[73] Assignee: Whirlpool Corporation, Benton Harbor, Mich.

[21] Appl. No.: 80,617

[22] Filed: Aug. 3, 1987

[51] Int. Cl.[4] ..... A47F 3/00

[52] U.S. Cl. ..... 312/229; 312/213; 312/138 R

[58] Field of Search ..... 312/213, 214, 302, 311, 312/229, 322, 326, 138 R, 139, 263, 330 R; 134/57 DL, 115 R, 113, 201; 292/200

[56] References Cited

U.S. PATENT DOCUMENTS

| | | | |
|---|---|---|---|
| 3,170,743 | 2/1965 | Martiniak | 312/213 |
| 3,294,461 | 12/1966 | Barnard et al. | 312/213 |
| 3,716,283 | 2/1973 | Little | 312/330 R |
| 3,854,762 | 12/1974 | Spiegel et al. | 292/200 |
| 4,087,143 | 5/1978 | Barnard et al. | 312/138 R |
| 4,171,150 | 10/1979 | Söderlund | 312/263 |
| 4,179,821 | 12/1979 | Herbst et al. | 312/213 |
| 4,247,158 | 1/1981 | Quayle | 312/229 |
| 4,458,965 | 7/1984 | Ohlendorf et al. | 312/330 R |

*Primary Examiner*—Victor N. Sakran

*Attorney, Agent, or Firm*—Mason, Kolehmainen, Rathburn & Wyss

[57] ABSTRACT

A dishwasher door includes a molded plastic control console and a molded plastic inner door that are secured to and interlocked on a metal frame to provide torsional rigidity and strength in the upper portion of the dishwasher door. The resultant torsional rigidity and strength in the upper portion of the dishwasher door improves the perceived quality of the door when open and ensures proper registration of the dishwasher door latch when the dishwasher door is closed. The console includes an integrally molded boss configured to receive and latch with an integrally molded projection of the inner door, thereby maintaining the console and inner door in an interlocked relationship. The console also includes a pair of spaced-apart resilient locking tabs for retaining the console in secure engagement with the metal frame. The console, frame and inner door are assembled in a single direction by placing the metal frame over and in engagement with the console, and, thereafter, by securing the inner door to the interconnected console and frame.

18 Claims, 3 Drawing Sheets

DISHWASHER DOOR WITH INTERLOCKING MOLDED CONSOLE AND MOLDED INNER DOOR

CROSSREFERENCE TO RELATED APPLICATION

The invention disclosed and claimed in this application is related to the subject matter disclosed and claimed in a co-pending, commonly assigned, U.S. patent application Ser. No. 865,514, filed on May 21, 1986 in the name of Anthony Mason.

BACKGROUND OF THE INVENTION

A. Field of the Invention

The present invention generally relates to appliance door constructions and, more particularly, to a new and improved automatic, front-loading dishwasher door with a molded console and molded inner door.

B. Description of the Prior Art

Door constructions, particularly those for electrical or gas kitchen appliances, are old and well-known in the prior art as exemplified by U.S. Pat. Nos. 1,686,831; 2,580,957; 2,623,249; 2,720,683; 2,859,843; 2,871,082; 3,024,074; 3,105,726; 3,149,624; 3,294,461; 3,313,065; 3,328,927; 3,525,190; 3,766,700; 3,773,399; 3,854,762; 3,936,107; and 4,229,921. The '831 patent relates to a door construction for a service cabinet. The '957 patent relates to an oven door construction having glass panels, ore of which is mounted for removal to permit the easy cleaning cf the interior faces of the glass panels. The '249 patent relates to a metal door construction having a removable panel.

The '683 patent concerns a refrigerator door construction and more specifically a scheme for mounting decorative panels to the outer surface of a refrigerator door. The '843 patent concerns architectural wall panels and the method and devices for mounting such wall panels to a wall. The '082 patent concerns the construction of a dishwasher door to achieve air circulation and the trapping of moisture.

The '074 patent also concerns the construction of a dishwasher door that provides for the venting of steam or vapor generated during the dishwashing process. The '726 patent concerns the construction of a desk to accommodate interchangeable panels for the desk. The '624 patent relates to the construction of a door for a kitchen range with an exterior finish for matching other kitchen furnishings.

The '461 patent relates to a dishwasher door construction as depicted in FIGS. 2–10 of that patent. As discussed in the '461 patent, the door construction disclosed therein is directed to providing a dishwasher door with a minimum number of parts and having a fixed particular fastener scheme for securing trim or decorative door panels to the door to facilitate the substitution of different door panels depending upon the decor desired. The '065 patent concerns the construction of a refrigerator door in a manner to achieve a desired decorative effect to the front of the door.

The '927 patent concerns paneling schemes for the interior wall of an elevator in which the decorative effect can be easily and quickly changed. The '190 patent concerns constructions for refrigerator doors and, more specifically, door trim and panel mounting assemblies. The '700 patent concerns an attachment scheme for securing decorative trim strips to the door of a kitchen appliance. The '399 patent concerns the construction of the front of a refuse compactor that provides for interchangeability of decorative front panels. The '762 patent discloses an automatic dishwasher of the type useful in connection with the present invention and is incorporated herein by reference for all purposes. The '762 patent specifically relates to a door latch for holding the dishwasher door in a sealed position. The '107 and '921 patents are discussed in detail in the "Background of the Invention" portion of the above-identified co-pending, commonly assigned patent application, which patent application is incorporated herein by reference for all purposes.

While, as discussed above, many different door constructions, particularly those for kitchen appliances, have been suggested, a need exists in the dishwasher field for the provision of increased rigidity with respect to door constructions of the type disclosed in the above-identified copending, commonly assigned patent application, formed basically by a polygonally-shaped metal frame weldment to which is secured a molded plastic console and a molded plastic inner door. In that type of construction, the door is pivotable between an open position and a closed position along a horizontal axis at the lower extremity of its metal frame. Because lightweight, molded plastic parts are used for the console and the inner door construction, the torsional rigidity in the upper door area is a concern. Without torsional rigidity in that area, the overall dishwasher door may seem to be of an insubstantial construction, reducing its perceived quality, and may result in a lack of registration of the interconnecting portions of the dishwasher door latch.

SUMMARY OF THE INVENTION

An object of the present invention is to provide a new and improved dishwasher door having a molded console and a molded inner door that are interlocked to provide increased torsional rigidity or strength in the upper portion of the dishwasher door.

Another object of the present invention is to provide a new and improved dishwasher door construction having a molded plastic inner door and a molded plastic console for the controls of the dishwasher in which the console and the inner door are interlocked to provide increased torsional rigidity to the door, particularly in the upper portion of the dishwasher door, thereby ensuring proper registration of the dishwasher door latch when the dishwasher door is closed.

Briefly, the present invention constitutes a new and improved dishwasher door constructed of a polygonally-shaped, specifically rectangularly-shaped, metal frame or weldment to which are secured a molded plastic inner door, a molded plastic console for dishwasher controls and a decorative front panel. The door frame includes a pair of spaced-apart supports disposed at the lower portion of the door frame for receipt within the dishwasher cabinet and about which the dishwasher door is pivotable between a closed position and an open position. The console, the frame and the inner door are designed to be assembled in a single direction by iritially placing the metal frame over and in engagement with the console and, subsequently, securing the inner door to the irterconnected console and frame. The console includes a pair of spaced-apart resilient locking tabs for releasably retaining the console in secure engagement with spaced-apart frame members. In addition, the console includes a slot forced in an integrally molded portion of the console and disposed along a lower edge of the console, that is configured to receive and interlock with a projection formed as an integrally molded portion of the inner door. In this manner, the console and the inner door are maintained in an interlocking arrangement to provide torsional rigidity or strength to the dishwasher door, particularly at the upper portion thereof. Thus, a simple, relatively inexpensive and lightweight dishwasher door is provided having sufficient torsional strength to achieve proper registration of mating components of the dishwasher door latch when the dishwasher door is placed in a closed position.

BRIEF DESCRIPTION OF THE DRAWING

The above and other objects, advantages and novel features of the present invention will become apparent from the following detailed description of the preferred embodiment of the present invention illustrated in the accompanying drawing wherein.

DESCRIPTION OF THE PREFERRED EMBODIMENT

Figure 2:
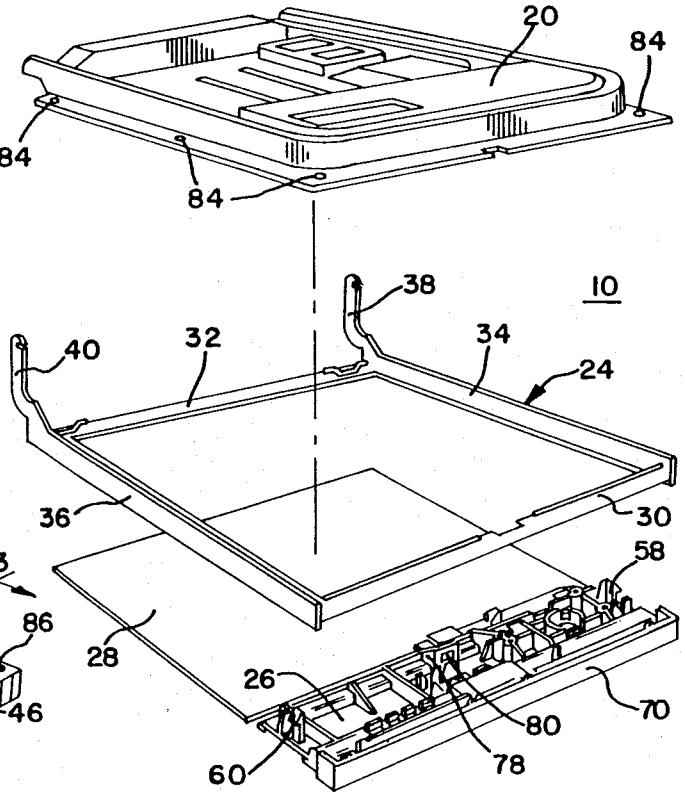
FIG. 2 is an exploded, perspective view of the major components of the dishwasher door depicted in FIG. 1.
Figure 1:
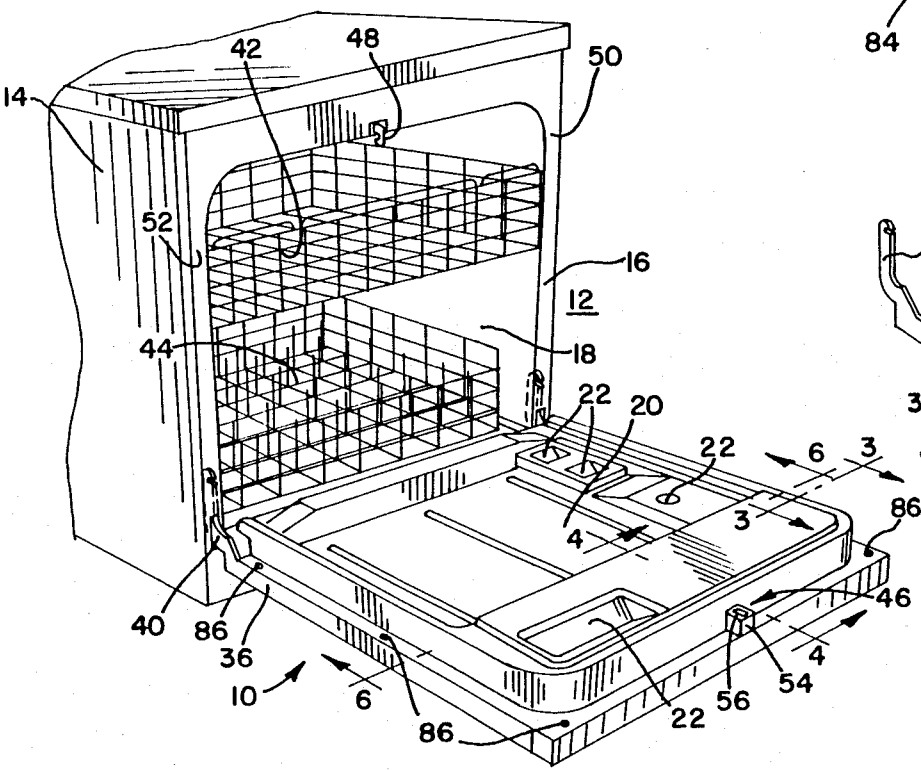
FIG. 1 is a fragmentary, perspective view of a dishwasher having a dishwasher door constructed in accordance with the principles of the present invention.

Referring to the drawing and initially to FIGS. 1–2, there is illustrated a new and improved dishwasher door 10 of a dishwasher 12. Other than the door 10, the internal components of the dishwasher 12 are conventional. Generally, the dishwasher 12 includes a cabinet 14 with an enlarged opening 16 at its front side to permit entry into an internal washing chamber or enclosure 18. The opening 16 has a conventional seal or gasket (not illustrated) disposed thereabout for mating with and forming a seal to a molded, plastic inner door 20 of the dishwasher door 10. The inner door 20 may be molded from any suitable plastic resin such as a copolymer resin formed, for example, from polypropylene and polyethylene. The door 20 is pivotably connected to the cabinet 14 at the bottom of the opening 16 and is pivotably movable about a horizontal axis between an open position (FIG. 1) and a closed position. When in a closed position, the inner door 20 tightly engages the seal or gasket disposed about the opening 16 to prevent leakage of water from the washing chamber 18. The inner door 20 may be molded as desired to form various different compartments and vents 22 for retaining detergent or rinsing materials and for enabling the escape of steam or vapor resulting from the dishwashing process. Reference may be had to the above-identified U.S. Pat. No. 3,854,762 for a more detailed discussion of conventional internal components for the dishwasher 12.

In accordance with an important feature of the present invention, the dishwasher door 10 includes, in addition to the inner door 20, a polygonally-shaped, specifically rectangularly-shaped, metal frame or weldment 24, a molded plastic control console 26 upon which the controls for the dishwasher 12 are mounted, and a decorative front panel assembly 28, that is fully disclosed in the above-identified copending and commonly assigned patent application. Reference may be had thereto for a detailed description of the front panel assembly 28 and of the manner in which it is secured to the frame 24. Furthermore, the electrical wires and wiring harness and the particular conventional controls commonly mounted on a dishwasher door are not part of the present invention and therefore have been omitted from the drawing for clarity.

The molded plastic console 26 may be formed from any suitable moldable plastic resin, for example, from a polyvinylchloride resin. The frame 24 includes an upper metal brace 30, a lower metal brace 32 and a pair of spaced-apart side frame members 34 and 36. The upper and lower metal braces 30 and 32 are interconnected with the side frame members 34 and 36 by any suitable means, for example, by welding, to form the frame or weldment 24. The side frame members 34 and 36, respectively, include lower, spaced-apart frame supports 38 and 40 for receipt within the cabinet 14 (FIG. 1). As is well known in the art, the dishwasher door 10 is thereby mounted to the cabinet 14 and is pivotably movable about a horizontal axis between the spaced-apart frame supports 38 and 40 between an open position (FIG. 1) and a closed position in which the inner door 20 is in a sealing engagement with the opening 16 of the cabinet 14.

As is conventional, the dishwasher 12 includes an upper dish rack 42, a lower dish rack 44 and a conventional door latch 46. The door latch 46 is conventional, per se, and, as illustrated in FIG. 1, includes a striker plate 48 conventionally mounted at the upper portion of the cpening 16 of the cabinet 14 approximately midway between a pair of spaced-apart vertical side walls 50 and 52 of the cabinet 14. In addition, the door latch 46 includes a conventional latch mechanism 54 diagramatically depicted in FIG. 1 as including a slot 56 for the receipt of the striker plate 48. As is conventional, the latch mechanism 54 is secured to the door 10 approximately midway between the frame members 34 and 36. In such a position, the latch mechanism 54 is properly registered with the striker plate 48 to enable the striker plate 48 to be received in the slot 56 when the door 10 is closed.

Figure 3:
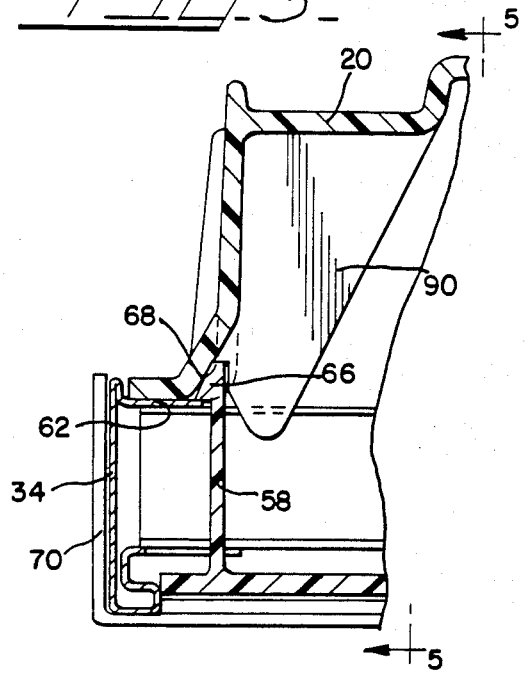
FIG. 3 is an enlarged, fragmentary, cross-sectional view of a portion of the dishwasher door of FIG. 1 taken along line 3—3 of FIG. 1.
Figure 6:
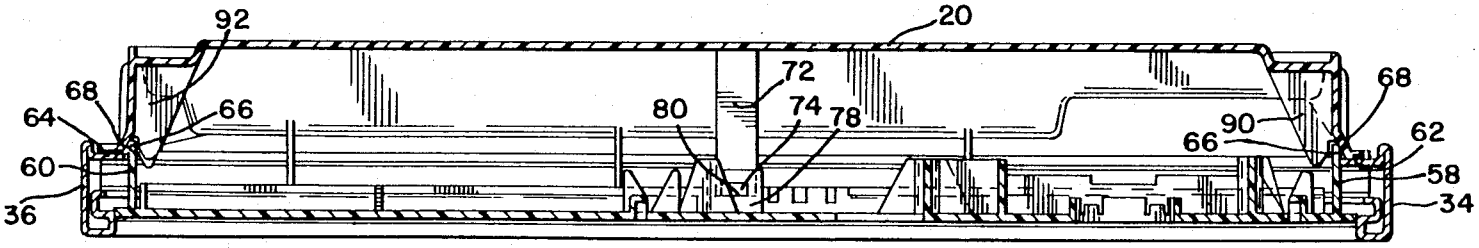
FIG. 6 is an enlarged, cross-sectional view of the dishwasher door of FIG. 1 taken along line 6—6 of FIG. 1.

In accordance with an important feature of the present invention, in order to provide torsional rigidity or strength to the upper portion of the dishwasher door 10 for ensuring proper registration between the latch mechanism 54 and the striker plate 48, the inner door 20, the frame 24 and the console 26 are assembled and interconnected as discussed hereinafter to achieve an interlocking relationship between the inner door 20 and the console 26. Initially, the console 26 is placed in a face-down condition (FIG. 2); and, subsequently, the frame 24 is moved down and into contact with the inner side of the console 26 (FIG. 2). The frame 24 and the console 26 are configured to snap together. To achieve this, a pair of spaced-apart, integrally molded resilient, locking tabs 58 and 60, formed during the molding process as integral portions of the console 26, are configured to snap over and respectively releasably retain a liner support leg 62 of the side frame member 34 and a liner support leg 64 of the side frame member 36. To achieve this snap-fit, interlocking relationship, each of the tabs 58 and 60 includes an enlarged head 66 (FIG. 3) having an inclined cam surface 68. As the frame 24 is placed in engagement with the console 26 (FIG. 2), the liner support leg 62 of each of the side frame members 34 and 36 engages the cam surfaces 68 and moves the heads 66 of the snap tabs 58 and 60 laterally inwardly until the liner support legs 62 and 64 clear the enlarged heads 66. The heads 66 are then moved laterally outwardly by the spring force stored in the deflected tabs 58 and 60 and return to their original position (FIGS. 3 and 6). A releasable, interlocking relationship between the frame 24 and the console 26 thus is achieved by the retention of the liner support leg 52 beneath and in contact with the enlarged head 66 of the snap tab 58. As is apparent (FIG. 2), the upper metal brace 30 and the upper portions of the side frame members 34 and 36 of the frame 24 are received within and shrouded or concealed by an elongated, generally U-shaped, integrally molded, decorative trim portion 70 (FIGS. 2 and 3) of the console 26.

Figure 4:
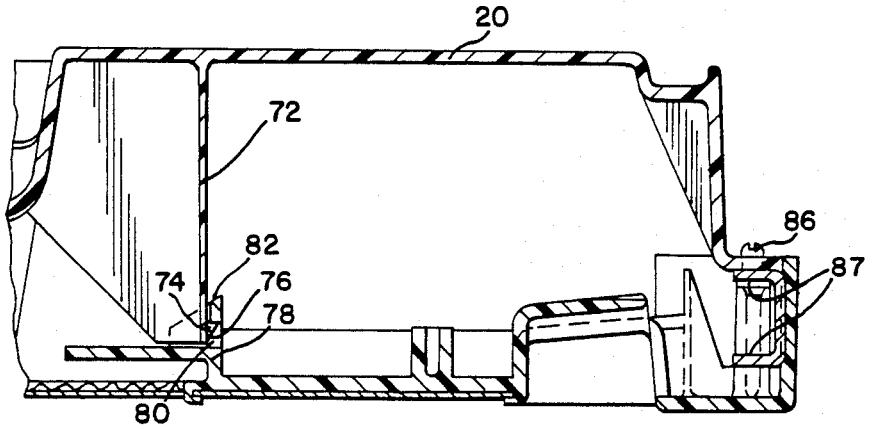
FIG. 4 is an enlarged, fragmentary, cross-sectional view of a portion of the dishwasher door of FIG. 1 taken along line 4—4 of FIG. 1.

After the frame 24 and the console 26 are interconnected as discussed above, the inner door 20 is moved downwardly (FIG. 2) into engagement with the interlocked subassembly formed by the frame 24 and the console 26. In accordance with an important feature of the present invention, the inner door 20 includes an elongate, integrally molded, plastic, resilient projection 72 (FIGS. 4 and 6) that includes enlarged head 74 having an inclined cam surface 76. The console 26 includes an upwardly extending, integrally molded, plastic interlocking portion or boss 78 formed with a slot 80 extending therethrough for receipt of the enlarged head 74 of the projection 72 of the inner door 20. As the inner door 20 is being brought into engagement with the interconnected subassembly formed by the frame 24 and the console 26, the inclined cam surface 76 of the projection 72 engages an inclined cam surface 82 of the interlocking portion 78 to resiliently deflect the enlarged head 74 and the molded projection 72 away from the interlocking portion 78. When the inner door 20 is moved sufficiently downwardly into engagement with the subassembly formed by the frame 24 and the console 26, the enlarged head 74 snaps into the slot 80, thereby interlocking the molded plastic inner door 20 and the molded plastic console 26 at the location of the interlocking portion 78. As is apparent, the interlocking portion 78 preferably is substantially more rigid than the molded projection 72 to result in the required resilient deflection of the molded projection 72 and the subsequent snap-fit engagement and interlocking relationship between the molded projection 72 and the interlocking portion 78.

The location of the interlocking portion 78 at the lower portion of the console 26, approximately midway between the side frame members 34 and 36 of the frame 24, and its interlocking relationship with the inner door 20 provides sufficient torsional strength and rigidity to the assembled door 10 to ensure that the latch mechanism 54 and the striker plate 48 of the door latch 46 are properly registered when the door 10 is closed.

Figure 5:
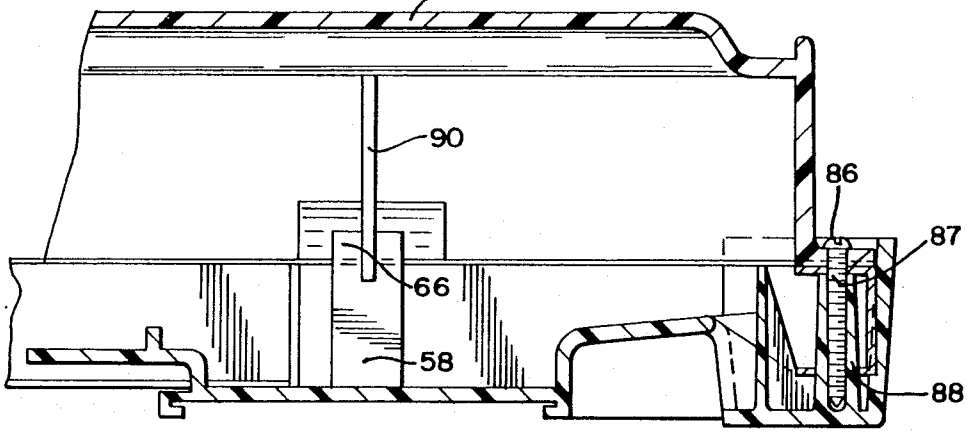
FIG. 5 is an enlarged, fragmentary, cross-sectional view of a portion of the dishwasher door of FIG. 1 taken along line 5—5 of FIG. 3.

Preferably, the inner door 20 includes a plurality of holes 84 (FIGS. 2, 4 and 5) for receipt of a plurality of threaded fasteners 86 (FIGS. 1, 4 and 5) for securing the inner door 20 to the subassembly formed by the frame 24 and the console 26. In this regard, suitable apertures 87 are formed through inwardly extending flange portions of the upper metal brace 30 and the side frame members 34 and 36. If desired, upwardly extending, integrally molded screw receiving bosses 88 (FIG. 5) may be formed in the console 26 for retaining the fasteners 86, thereby fixedly securing the inner door 20, the frame 24 and the console 26 together as an assembly to form the door 10.

In accordance with an additional important feature of the present invention, the inner door 20 includes a pair of spaced-apart, downwardly projecting, integrally molded ribs 90 and 92 (FIGS. 3, 5 and 6) for contacting, respectively, the tabs 58 and 60. In this manner, substantial inward lateral movement of the tabs 58 and 60 is prevented and the retention of the enlarged heads 66 of the tabs 58 and 60 in engagement with the liner support legs 62 and 64, respectively, is achieved.

Obviously, many modifications and variations of the present invention are possible in light of the above teachings. Thus, it is to be understood that, within the scope of the appended claims, the invention may be practiced otherwise than as specifically described hereinabove.

What is claimed and is desired to be secured by Letters Patent is:

1. An automatic front-loading dishwasher comprising a cabinet having an enlarged opening for access to an internally disposed washing chamber, a dishwasher door pivotably movable between an open position and a closed position, said dishwasher door in said closed position closing said opening to said washing chamber, said dishwasher door including a molded plastic control console and a molded plastic inner door, said console and said inner door including means for securing said console and said inner door in an interlocked relationship and increasing the torsional rigidity of said dishwasher door in the area of said console, said securing means including complementary directly engageable interlocking members, one of said interlocking members being disposed on said console and the other in said inner door.

2. An automatic front-loading dishwasher as recited in claim 1 wherein said dishwasher door further comprises a polygonally-shaped, metal frame and means for releasably securing said console to said metal frame.

3. An automatic front-loading dishwasher as recited in claim 2 wherein said releasably securing means comprises a pair of spaced apart, resilient tabs formed as integral portions of said console for releasably engaging and interconnecting said console and said metal frame.

4. An automatic front-loading dishwasher as recited in claim 2 wherein said interlocking members comprises a first integrally formed portion of said console and a second integrally formed portion of said inner door, said first portion and said second portion being configured to engage and interlock when said inner door is fully assembled in engagement with said frame and said console.

5. An automatic front-loading dishwasher as recited in claim 4 wherein said first portion comprises an upstanding boss.

6. An automatic front-loading dishwasher as recited in claim 1 further comprising latch means for latching said cabinet and said dishwasher door when said dishwasher door is placed in said closed position, said latch means including a first latch component disposed on said cabinet at an upper portion of said opening and a second mating latch component disposed on said dishwasher door, said securing means being effective to ensure proper registration between said first and second latch components when said dishwasher door is closed.

7. An automatic front-loading dishwasher comprising a cabinet having an enlarged opening for access to an internally disposed washing chamber, a dishwasher door pivotably movable between an open position and a closed position, said dishwasher door in said closed position closing said opening to said washing chamber, said dishwasher door including a molded plastic control console and a molded plastic inner door, said console and said inner door including interlocking means for interlocking said console and said inner door and, thereby, for increasing the torsional rigidity of said dishwasher door in the area of said console, said dishwasher door further including a polygonally-shaped, metal frame and means for releasably securing said console to said metal frame, wherein said releasably securing means comprises a pair of spaced apart, resilient tabs formed as integral portions of said console for releasably engaging and interconnecting said console and said metal frame, and wherein said inner door includes a pair of integrally formed, spaced apart projections each configured to engage one of said resilient tabs of said console to maintain said tabs in engagement with said metal frame.

8. An automatic front-loading dishwasher comprising a cabinet having an enlarged opening for access to an internally disposed washing chamber, a dishwasher door pivotably movable between an open position and a closed position, said dishwasher door in said closed position closing said opening to said washing chamber, said dishwasher door including a molded plastic control console, a molded plastic inner door and a polygonally shaped metal frame, said console and said inner door including interlocking means for interlocking said console and said inner door and, thereby, for increasing the torsional rigidity of said dishwasher door in the area of said console, said interlocking means including a first integrally formed portion of said console and a second integrally formed portion of said inner door, said first portion and said second portion being configured to engage and interlock when said inner door is fully assembled in engagement with said frame and said console, wherein said first portion comprises an upstanding boss, and wherein said second portion comprises an elongate resilient projection having an enlarged head, said boss being configured to receive and retain said enlarged head in an interlocking relationship.

9. An automatic front-loading dishwasher comprising a cabinet having an enlarged opening for access to an internally disposed washing chamber and a dishwasher door movable between an open position and a closed position, said dishwasher door in said closed position closing said opening to said washing chamber, said dishwasher door comprising a rigid frame, a molded plastic control console and a molded plastic inner door, said console and said inner door including means for securing said console and said inner door in an interlocked relationship and increasing the torsional rigidity of said dishwasher door in the area of said console, said securing means including complementary directly engageable interlocking members, one of said interlocking members being disposed in said console and the other on said door.

10. An automatic front-loading dishwasher as recited in claim 9 wherein said interlocking members comprise a first integrally formed portion of said console and a second integrally formed portion of said inner door.

11. An automatic front-loading dishwasher as recited in claim 10 wherein said first portion includes an upwardly extending boss.

12. An automatic front-loading dishwasher as recited in claim 10 wherein said console further includes a plurality of integrally formed resilient tabs for releasably, securely engaging and retaining said frame.

13. An automatic front-loading dishwasher comprising a cabinet having an enlarged opening for access to an internally disposed washing chamber and a dishwasher door movable between an open position and a closed position, said dishwasher door in said closed position closing said opening to said washing chamber, said dishwasher door comprising a rigid frame, a molded plastic control console and a molded plastic inner door, said console and said inner door including means for interlocking said console and said inner door and, thereby, for increasing the torsional rigidity of said dishwasher door in the area of said console, said interlocking means including a first integrally formed portion of said console and a second integrally formed portion of said inner door, wherein said first portion includes an upwardly extending boss, and wherein said second portion comprises an elongate, downwardly extending resilient projection having an enlarged head for forming an interlocking relationship with said boss when said inner door is assembled to said frame and said console.

14. An automatic front-loading dishwasher comprising a cabinet having an enlarged opening for access to an internally disposed washing chamber and a dishwasher door movable between an open position and a closed position, said dishwasher door in said closed position closing said opening to said washing chamber, said dishwasher door comprising a rigid frame, a molded plastic control console and a molded plastic inner door, said console and said inner door including means for interlocking said console and said inner door and, thereby, for increasing the torsional rigidity of said dishwasher door in the area of said console, said interlocking means including a first integrally formed portion of said console and a second integrally formed portion of said inner door, wherein said console further includes a plurality of integrally formed resilient tabs for releasably, securely engaging and retaining said frame, and wherein said inner door further includes a plurality of integrally formed rigid projections respectively for engaging portions of said resilient tabs to maintain an interlocking relationship between said console and said frame.

15. A method of manufacturing an automatic dishwasher comprising the steps of forming a polygonally-shaped, metal frame for a dishwasher door, molding a control console for said dishwasher door from a plastic material, molding an inner door of said dishwasher door from a plastic material, assembling said metal frame into engagement with said console, assembling said inner door into engagement with said frame and said console and interlocking said inner door and said console together by means of an interlocking engagement between a first integrally formed portion of said console and a second integrally formed portion of said inner door.

16. A method of manufacturing an automatic dishwasher as recited in claim 15 wherein said step of assembling said frame member into engagement with said console includes the step of releasably interlocking said console and said frame member by the engagement of a plurality of integrally formed resilient tabs of said console with a plurality of spaced apart portions of said metal frame.

17. A method of manufacturing an automatic dishwasher as recited in claim 15 wherein said two molding steps respectively include the step of molding a boss as an integral component of said console and molding an elongate, resilient projection in a configuration to interlock with said boss as an integral component of said inner door.

18. A method of manufacturing an automatic dishwasher comprising the steps of forming a polygonally-shaped, metal frame for a dishwasher door, molding a control console for said dishwasher door from a plastic material, molding an inner door of said dishwasher door from a plastic material, assembling said metal frame into engagement with said console, assembling said inner door into engagement with said frame and said console and interlocking said inner door and said console together by means of an interlocking engagement between a first integrally formed portion of said console and a second integrally formed portion of said inner door, wherein said step of assembling said frame member into engagement with said console includes the step of releasably interlocking said console and said frame member by the engagement of a plurality of integrally formed resilient tabs of said console with a plurality of spaced apart portions of said metal frame, and wherein said step of assembling said inner door into engagement with said frame and said console includes the step of disposing a plurality of integrally formed, rigid projections formed in said inner door in engagement with portions of said resilient tabs to securely retain said resilient tabs in engagement with said portions of said metal frame.

* * * * *